United States Patent [19]

Yamaguchi

[11] 4,330,196

[45] May 18, 1982

[54] ELECTROPHOTOGRAPHIC COPYING APPARATUS

[75] Inventor: Isao Yamaguchi, Yawata, Japan

[73] Assignee: Matsushita Electric Industrial Co., Ltd., Kadoma, Japan

[21] Appl. No.: 120,986

[22] Filed: Feb. 13, 1980

[30] Foreign Application Priority Data

Feb. 22, 1979 [JP] Japan ..... 54-20464
Feb. 23, 1979 [JP] Japan ..... 54-21257

[51] Int. Cl.[3] ..... G03G 15/28
[52] U.S. Cl. ..... 355/8; 355/3 R
[58] Field of Search ..... 355/3 R, 8, 16

[56] References Cited

U.S. PATENT DOCUMENTS 3,790,273 2/1974 Tanaka ..... 355/16
3,796,488 3/1974 Tanaka et al. ..... 355/16
3,819,261 6/1974 Ogawa ..... 355/8 X
3,912,390 10/1975 van Herten ..... 355/16 X

*Primary Examiner*—Fred L. Braun
*Attorney, Agent, or Firm*—Cushman, Darby & Cushman

[57] ABSTRACT

An electrophotographic copying apparatus has a rotatable photoreceptor having a photoconductive outer layer. An optical scanning arrangement includes an illuminating system and an optical system for projecting a light image from an original onto the photoreceptor. A developing system is provided for developing the latent image into a visible toner powder image, together with a transferring arrangement for transferring the toner powder image onto a copy paper sheet. A fixing arrangement is provided for fixing the transferred visible toner powder image on a copy paper sheet. A housing is provided which contains the photoreceptor, the optical scanning arrangement, the developing system, the transferring arrangement, and the fixing arrangement. Mounted within the housing are a first motor for the photoreceptor drum, a second motor for the optical scanning arrangement, a third motor for the developing system, and a fourth motor for the fixing arrangement. Each of the motors is of a flat type coreless motor disposed with its output shaft extending inwardly of the housing.

8 Claims, 7 Drawing Figures

ELECTROPHOTOGRAPHIC COPYING APPARATUS

BACKGROUND OF THE INVENTION

1. Field of the Invention

The present invention relates to a copying apparatus, and more particularly; to an electrophotographic copying apparaus employing a photoreceptor to form an electrostatic latent image of an original to be copied thereon, which latent image is subsequently developed into visible toner powder image to be transferred and fixed onto a copy paper sheet.

2. Description of the Prior Art

In general an electrophotographic copying apparatus has a photoreceptor having a photoconductor surface thereon, and an electrostatic latent image of an original is formed on it by projecting an optical image of the original thereon. Then, the latent image is transferred into a visible image of toner particles by utilizing developer, thereby the toner image is further transferred onto a surface of a copy paper sheet. The receptor is usually shaped as a drum which is journaled rotatably around its axis. The electrophotographic copying apparatus further operably comprises around the receptor a corona charging means for preliminarily charging said photoreceptor, an optical means for projecting the image of the original onto the surface of the photoreceptor, a developing means for developing a latent image on the photoreceptor of the original thereby to obtain a toner image, a transferring means for transferring the toner image onto a surface of copy paper sheet and a cleaning means for cleaning a residual toner image remaining after the transferring. The copying apparatus further comprises a copying paper feeding apparatus and a fixing means for fixing the toner image on the copying paper sheet. In order to project the image of the original onto the surface of the cylindrical photoreceptor, the optical means comprises an optical scanning device which scans the original to obtain a latent image of the linear part of the original which linear part moves vertically to the linear part. To perform the copying operation, the optical scanning means needs to move reciprocally, different from the single direction movings of the photoreceptor drum, the paper sheet feed-in means and a means to advance the paper sheet from the transferring means to the fixing means.

Hitherto, the electrophotographic copying apparatus has employed a single A.C. motor, for example a synchronous motor or an induction motor of a considerably large output power as a driving means for the motions of the abovementioned means, and a single direction motion of the motor is transmitted to the various means which require the single direction motions and a pair of electromagnetic clutches are used to obtain the reciprocation motions of the optical scanning means.

In such conventional copying apparatus, the photoreceptor drum and the optical scanning means have been driven by a common motor, in order to assure complete coincidence of surface speeds of the photoreceptor drum and the scanning of the original. The coincidence is necessary for accurate reproduction of the copied image, and without such coincidence the reproduced image becomes distorted, for example shortened or elongated. In order to obtain such coincidence, a chain transmission system, which accurately transmits the revolution from the common motor to the photoreceptor drum and the optical scanning means, has been used.

In such conventional copying apparatus, for driving the revolutions of the photoreceptor, developing means, fixing means, copy paper sheet driving roller and optical scanning means, a considerably large A.C. motor having axial output power of such as 60–90 W is used. Furthermore, in order to produce reciprocation motion of the optical scanning means, a pair of electromagnetic clutches is necessary, and such electromagnetic clutches are generally expensive and consume consideable electric power.

In a second type conventional apparatus, in order to reduce the large power of the motor, a second A.C. motor has been used to drive the developing means which requires a considerable torque. In such apparatus, both the optical scanning means and the photoreceptor are driven by a first motor. Though a first motor and the second motor can be made smaller than the single motor of the first type conventional apparatus, the total of the volume and weight of the two motors of the second type conventional apparatus becomes larger than those of the single motor of the first type apparatus, and hence the use of two ordinary A.C. motors is not appropriate for a small and light type electrophotographic copying apparatus.

The A.C. motor such as the synchronous motor or the induction motor has a considerably high rotation speed such as 1800 rpm, and therefore, it is necessary to use a gear head having a reduction ratio of one several tenth inserted between the output shaft of the motor and the driven shafts of the abovementioned means and devices. Such gear head makes a considerable noise, besides the noises produced by the chains and sprocket therefor.

Furthermore, by attaching the gear head between the motor shaft and the driven devices, the totals of the length and space required for containing the combination of the motor and the gear head become large, and therefore, the housing of the copying apparatus becomes large.

Besides, use of the chain transmission system which connects the motor, electromagnetic clutches and various driven devices requires certain spaces in the housing, thereby increasing the volume and further makes the construction of the devices complicated, and assembling of the copying apparatus has been complicated because of the use of chain or belt transmission system.

SUMMARY OF THE INVENTION

The present invention provides an electrographic copying apparatus that can eliminate the abovementioned shortcomings by adopting use of a plural number of small size electric motors and dispenses with the chain transmission system.

By the use of the plural number of small size motors and elimination of the chain transmission system, the noise, the size, the weight, and the power consumption of the copying apparatus can be reduced.

DESCRIPTION OF THE PREFERRED EMBODIMENT

The electrophotographic copying apparatus in accordance with the present invention comprises:

a photoreceptor having a photoconductive outer layer which photoreceptor is rotatably disposed, a corona charger for preliminarily charging the photoconductive outer layer of said photoreceptor, an optical scanning means including illuminating means for an original to be copied, an optical system for projectng a light image from said original onto said preliminarily charged photoconductive layer and a driving means to drive at least the illuminating means and the optical system in a manner relatively to scan on the original, thereby to produce an electrostatic latent image on said photoconductive layer, a developing means for developing the latent image into a visible toner image by contact of toner on said conductive layer, a transferring means for transferring said toner image onto a transfer material sheet which is fed by a sheet feeding device, a cleaning means for removing residual toner after the transferring, a fixing means disposed in the path of the transfer material and including a fixing device for fixing the transferred visible toner image on said transfer material, a transfer material advancing means for advancing said transfer material from a feeder onto the outer surface of said photoreceptor and through said fixing means to an outlet, and an apparatus housing for, in operatively incorporated relation, containing the photoreceptor, the corona charger, the optical scanning means, the developing means, the transferring means, the cleaning means, the fixing means and the transfer material advancing means, wherein the improvement is that:

the apparatus housing comprises, on one side part thereof, a first motor for driving and coupled to the photoreceptor, a second motor for driving and coupled to the optical scanning means, each of said first motor and said second motor having a rotation speed detecting means, rotation speed of said first motor being predetermined constant, and rotation speed of said second motor during forward direction scanning for projecting image of said original onto the photoreceptor is selected to have a predetermined ratio to said predetermined constant speed by means of output signals of said rotation speed detecting means.

Hereinafter, the present invention is elucidated in detail referring to the examples shown in the accompanying drawings.

Figure 4:
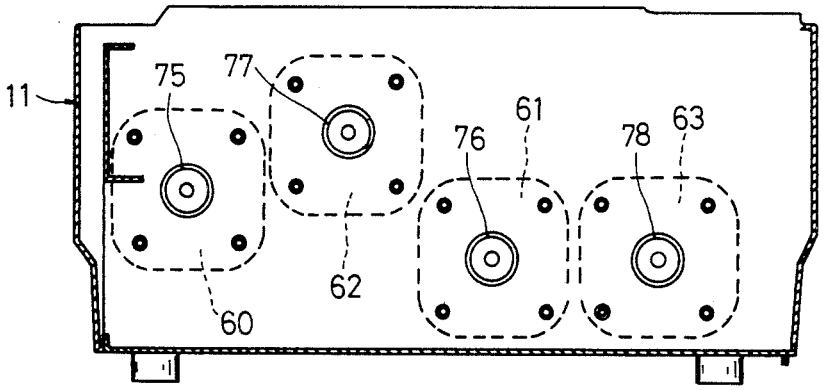
FIG. 4 is another sectional side view of the first example.
Figure 5:
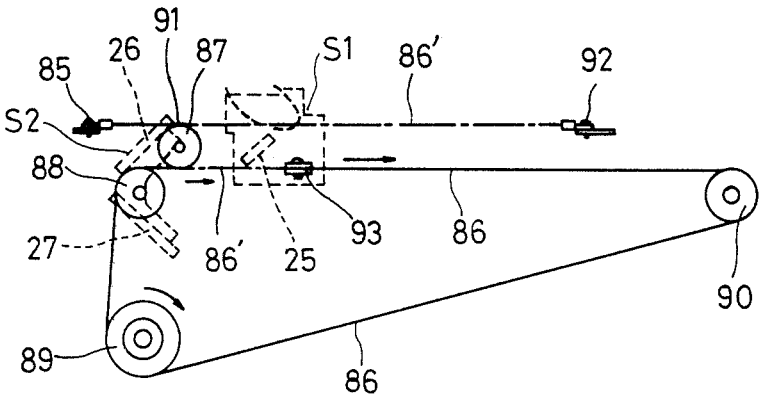
FIG. 5 is a sectional view showing construction of main part of the driving means of the optical scanning means.
Figure 6:
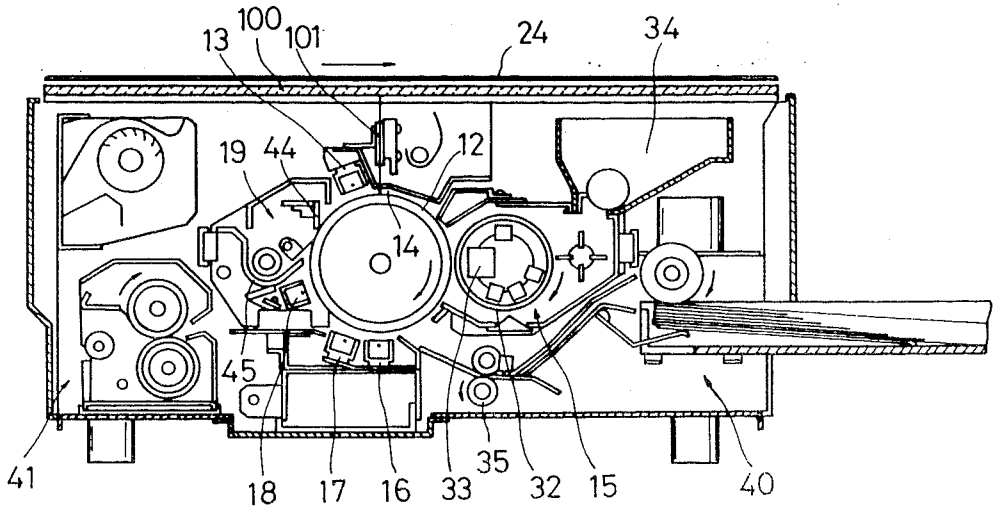
FIG. 6 is a sectional side view of a second example of the electrophotographic copying apparatus embodying the present invention.
Figure 7:
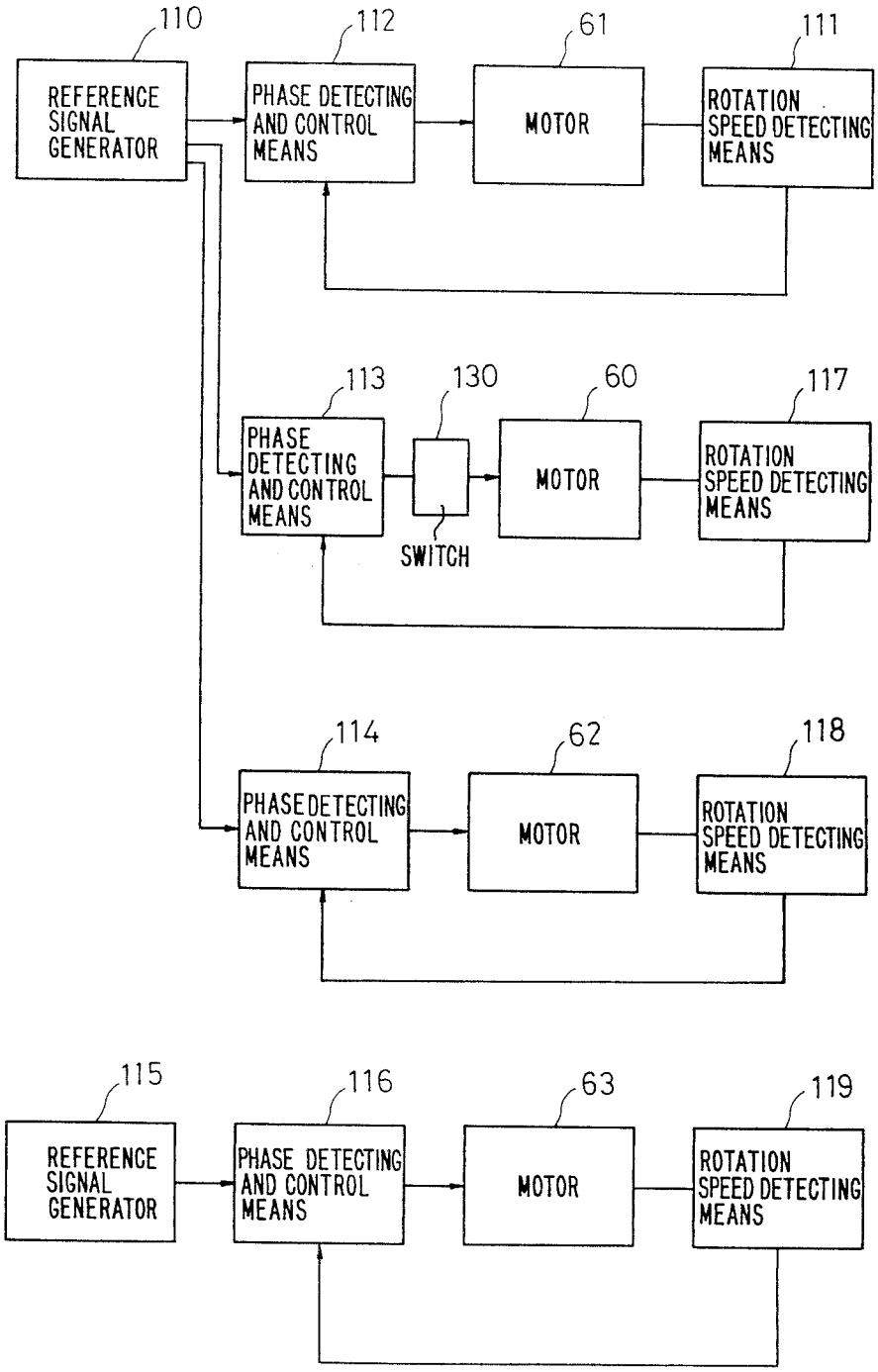
FIG. 7 is a block diagram of the circuit construction of the motor driving circuit of the examples of FIGS. 1-6.

FIGS. 1 to 5 show a first example embodying the present invention and FIG. 6 shows a second example embodying the present invention, and FIG. 7 shows a block diagram of an example of circuit for driving the motors of the copying device of FIGS. 1 to 5 or FIG. 6.

Figure 1:
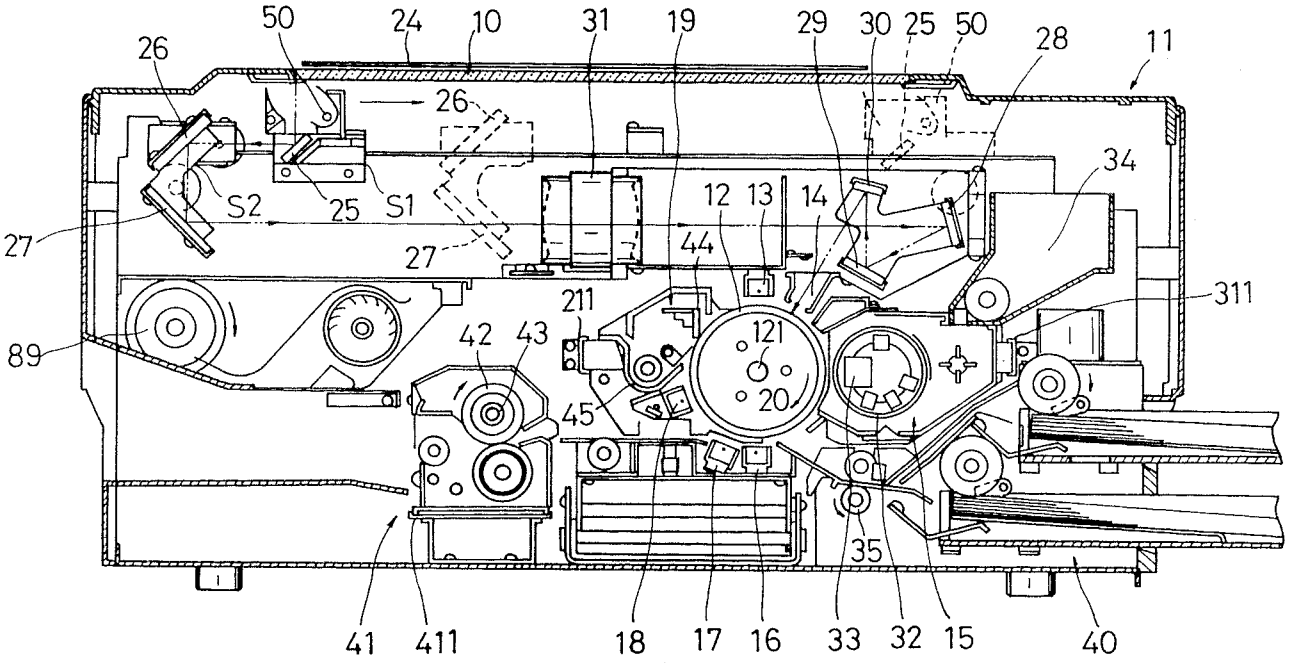
FIG. 1 is a sectional side view of a first example of the electrophotographic copying apparatus embodying the present invention.

As shown in FIG. 1, a photoreceptor drum 12 having a photoconductor layer on its cylindrical outer surface is disposed rotatably by its shaft 121 in the central part of the housing 11. A corona charger 13, an exposure slit 14, a developer 15, a transferring charger 16, a copying paper sheet separating discharger 17, a photoreceptor discharger 18 and a cleaner 19 are operatively disposed around the photoreceptor drum 12 in this order.

The abovementioned corona charger 13 is for donating charges onto the photoconductive layer of the photoreceptor 12. The corona charger 13 comprise a charging wire on which a positive potential of about 5 to 6 KV in a case to use a selenium layer as the photoconductive layer, and uniformly charges the surface of the photoconductive layer as the photoreceptor drum rotates in the direction of the arrow 20 by means of a corona discharging from the charging wire. This corona charging makes a preliminary charging of the photoreceptor.

The original 24 is disposed on a stationary transparent platform 10 and is illuminated by a moving tubular lamp 50 of a illuminating means, and the light reflected from the illuminated part of the original is directed onto the photoconductive layer of the photoreceptor via a first moving mirror 25, second and third moving mirrors 26 and 27, an image projection lens 31, stationary mirrors 28, 29 and 30 and an exposure slit 14, thereby to project an image of the original 24 on the photoconductive layer surface. The tubular lamp 50 and the first moving mirror are mounted on a first slider S1 which scans very fast and the second and the third mirrors 26 and 27 are mounted on a second slider S2 which scans slower than the first slider S1, and these components together constitute the scanning means.

By the projection of the light image, an electrostatic latent image is formed on the photoconductive layer.

The developing means comprises a rotatable non-magnetic roller 32 including a permanent magnet 33 therein. Developing material consisting of toner powder and carrier particles of very small iron balls is brought up and forms magnetic brush by means of magnetic force of the permanent magnet 33, thereby forming magnetic brush bristles of about 5 mm length around the outer surface of the non-magnetic roller 32, which bristles slide the photoconductive layer as both the non-magnetic roller 32 and the photoreceptor drum rotate. By such sliding by the magnetic brush bristles containing toner powder, the latent image on the photoreceptor is developed into a visible toner image. The developing means comprises a toner powder feeding means 34 for automatically supplying appropriate amount of the toner powder. Instead of the abovementioned toner powder type developing means, a liquid type developer of a toner solution can be used.

The transferring means comprises a transfer charger 16, a transfer material sheet separating charger 17 and transfer-material sheet advancing roller 35, which feeds each one transfer-material sheet, such as plain copy paper, into a gap between the photoreceptor drum 12 and the transfer charger 16 for each transferring of the developed visible toner image.

As the photoreceptor drum 12 rotates, and the part of the drum surface bearing the developed visible toner image reaches the position to face the transfer charger 16, the part of the visible toner image which faces the transfer charger 16 is transferred on the transfer material sheet, and accordingly, as the photoreceptor drum rotates and the transfer material sheet advances the toner image is transferred onto the transfer material sheet. In the example of the present invention, the transfer charger 16 is impressed with a positive high tension potential and the transfer material sheet separating charger 17 is impressed with an A.C. high tension potential. By means of the A.C. corona produced by the transfer material sheet separating charger 17, the transfer material sheet, which once has stuck on the photoreceptor drum 12 at the charging by the transfer charger 16, is separated from the photoreceptor drum and is sent to the fixing means 41.

The fixing means comprises a rotating roller 42 and a lamp 43 disposed in and for heating the roller 42 to about 200° C. The rotating heated roller 42 constitutes a fixing device, with which the transfer material sheet with transferred toner image thereon is heated and pressed, and therefore the toner powder image is firmly fixed on the transfer material sheet. The peripheral speed of the fixing roller 42 is driven equal to that of photoreceptor drum 12 in order to obtain a reproduced image without distortion. If the peripheral speed of the fixing roller 42 is faster than that of the photoreceptor 12, the transfer material sheet is pulled by force, and therefore, the transfer material sheet in the transferring process is also pulled by force, thereby causing elongation of the transferred image with respect to the actual image. On the contrary, if the peripheral speed of the fixing roller 42 is slower than that of the photoreceptor 12, sending out of the exit of the fixed transfer material sheet becomes slower than receiving of the subsequent transfer material sheets, and therefore the transfer material sheet is pushed by the subsequent one, thereby making undesirable bending and resultant rubbing of unfixed toner image on the nearby part, such as the bottom of the discharger 18, thereby resulting in damage of the reproduced image.

As elucidated above, the peripheral speeds of the roller 42 and the photoreceptor 12 must be accurately equal. Because of the similar reason, the peripheral speed of the transfer material advancing roller 35 must be equal to that of the photoreceptor drum 12.

After the separation of the transfer material sheet from the photoreceptor drum 12, the residual charge of the photoconductive layer of the photoreceptor drum 12 is removed by means of the photoreceptor discharger 18, which is impressed with an A.C. high tension potential and produces A.C. corona to discharge the charges on the photoconductive layer surface.

Subsequent to the discharging, the surface of the photoreceptor drum 12 is cleaned by the cleaner 19, which comprises elastic blade 44 made of, for example, polyurethane rubber, and contacts the outer surface of the drum 12, by its blade edge part. As the drum 12 rotates, the residual toner powder on the photoreceptor drum 12 is cleaned by the blade 44, and the collected toner powder is returned into a toner container 45 of the cleaner 19.

The construction of the optical scanning means is elucidated hereafter. As has been described, the first moving mirror 25 and the illuminating lamp 50 are mounted on a first slider S1 which is disposed beneath the transparent and stationary platform 10 in a manner to move parallelly to the platform 10 (from left hand starting position to right hand end position in FIG. 1 for image scanning and in the opposite direction for restoring to the starting position). The moving mirror 25 is mounted on the first slider with a 45° angle position to the platform 10, and the light reflected by the original 24 is reflected by the moving mirror 25 to reach the second moving mirror 26. The second and third moving mirrors 26 and 27 are disposed with −45° and +45° angle to the platform and cooperatively reflect the light from the original 24 to the projection lens 31. The second and third moving mirrors 26 and 27 moves on the second slider S2 in the same direction and at a half speed of that of the first moving mirror 25, by means of known mechanical linkage. Therefore, during the moving of the first mirror 25 from the starting position to the end position, the total distance of the light path from the original 24 through the mirrors 25, 26 and 27 to the lens 31 is kept constant.

This distance is selected to be twice as large as a focal length of the lens 31.

The scanning movement of the first and second moving mirrors 25, 26 and 27 is first made from the starting position (left side of the original 24 to the right side thereof, in FIG. 1) at a predetermined speed, and then is reversely made at a possible high speed thereby returning the first and second moving mirrors 25, 26 and 27 to the respective starting positions.

The light coming through the lens 31 is reflected by the mirrors 28, 29 and 30, and then is projected through the exposure slit 14 onto the surface of the photoreceptor 12. A distance from the lens 31 to the photoreceptor 12 is set to be twice as large as the focal length of the lens 31. Accordingly, an image having the same size as that of the original is projected on the surface of the photoreceptor 12.

The scanning movement of the first moving mirror 25 in the forward direction is driven by a motor 60 for driving the optical scanning mechanism, in a manner that its scanning speed is equal to the peripheral speed of the photoreceptor drum 12. On the other hand, the second and the third moving mirrors 26 and 27 are scanned by the motor 60 in the same direction at a speed half of the peripheral speed of the photoreceptor drum 12.

Next, a mechanism for moving the first slider S1 for the first moving mirror 25 and the second slider S2 for the second and third moving mirrors 26 and 27 is explained. As shown in FIG. 5, a wire 86 whose one end is fixed to a stationary position designated by 85 of a housing 11 is turned up by (a first movable pulley 87 provided on) the second slider S2, and further turned up by a first fixed pulley 88 fixed to the housing. The wire 86 is then wound around a drive pulley 89 rotatably journalled on the housing by a few times and is turned up by a second fixed pulley 90 fixed to the housing 11 and then the other end is fixed to a point 93 on the first slider S1. One end of a second wire 86' (shown by the chain line) is fixed to the point 93 on the first slider S1 and is turned up by a second movable pulley 91 which is provided on the second slider S2, for example, in coaxial relation with the abovementioned first movable pulley 87 and is fixed to a position designated by 92 of the housing 11. That is, the first slider S1, carrying the moving mirror 25, is fixed to the connecting point between the ends of the wires 86 and 86' at an intermediate position between the second movable pulley 91 and the second fixed pulley 90. Therefore, in case the scanning drive pulley 89 rotates in the clockwise direction as shown by the arrow as in FIG. 5, the first moving mirror 25 on the first slider S1 fixed to the wires 86, 86' at a position designated by 93 moves to the right direction at a peripheral speed of the scanning drive pulley 89, and the second and the third movable mirrors 26 and 27 on the second slider S2 moves at a speed half of the peripheral speed of the scanning drive pulley 89. This scanning drive pulley 89 is connected to the output shaft of a belowmentioned motor 60 for driving the optical scanning mechanism, through a low ratio gears if preferable. The motor 60 can be rotated in both directions by electric switchings. Therefore, the first moving mirror 25 and the second and the third moving mirrors 26, 27 move a return trip at respective predetermined speeds.

The abovementioned photoreceptor drum 12, the developing device 15, the copy paper sheet feeder 40, the fixing device 41, the cleaner 19 and so on are made as an independent assembly unit, and they are inserted into specified positions of the copying apparatus housing 11 shown in FIG. 1 by means of guide members 211, 311, 411 and so on. The optical scanning mechanism including the first, the second and the third moving mirrors 25, 26 and 27 is preferably loaded into the housing 11 from the upper part by moving the platform 10.

Figure 2:
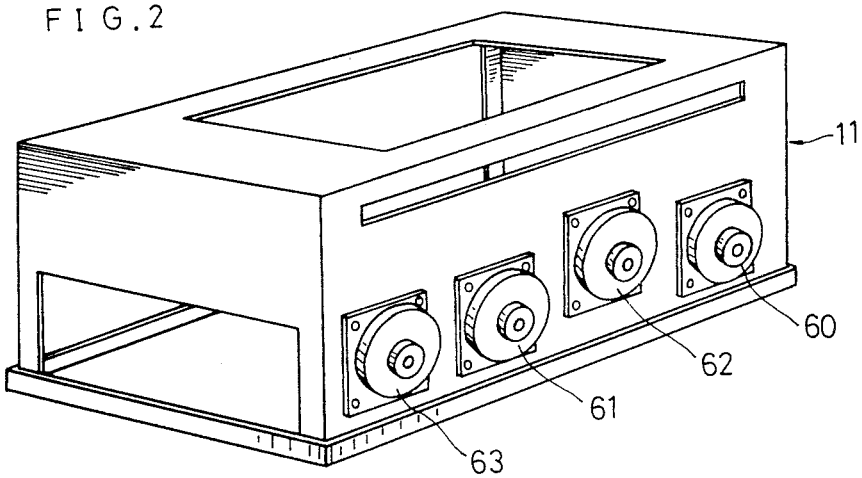
FIG. 2 is a perspective view showing how four flat type D.C. motors are provided to the housing of the electrophotographic copying apparatus of FIG. 1.

In the embodiment of the present invention, the photoreceptor drum 12 at its peripheral surface, the fixing roller 42 of the fixing device 41 at its peripheral surface and the first slider S1 of the optical scanning mechanism are driven at the same speed, respectively. Next, the driving structure for such equal speed driving is explained as follows: FIG. 2 is a perspective view seen from the side opposite to FIG. 1. In the embodiment of the present invention, three independent motors 60, 61 and 62 respectively for driving the photoreceptor drum 12, the fixing device 41, and the optical scanning mechanism are fixed on one side wall of the copying apparatus housing 11. The motor 60 is for driving the optical scanning mechanism and rotates both clockwise and anticlockwise rotational directions. The motor 61 is for driving the photoreceptor drum 12, and the motor 62 is for driving the fixing device 41. Another motor 63 for driving the rotary sleeve 32 is also fixed to the same side wall of the copying apparatus housing 11.

Flat and core-less type D.C. motors which include a flat rotor having coils wound in a flat disc shape and molded with resin and having output power of about 20 W order are used as the four motors 60 to 63. Such motors have very small inertia of rotation of rotor, very quick rise up of rotation and light weight, and therefore are suitable for the purpose of the present invention.

Figure 3:
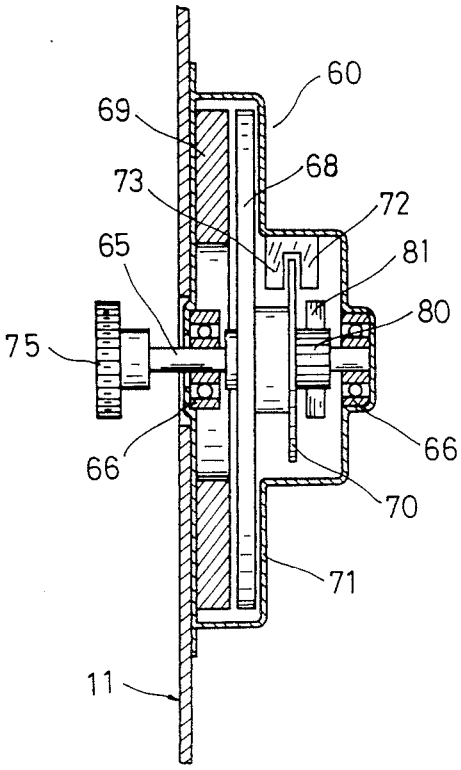
FIG. 3 is a sectional view of the flat type D.C. motor of FIG. 2.

FIG. 3 shows a sectional view of the small sized core-less D.C. motor 60 including an encoder used in the embodiment of the present invention. In this figure, a rotor constituted by a disc shaped resin-molded coil 68 is mounted on a shaft 65 which is rotatably journalled by a bearing 66. The rotor 68 is rotatably disposed in a ring shaped magnetic field formed by a permanent magnet 69. The windings of the rotor 68 is fed with a D.C. current through a commutator 80, and a brush 81.

A slit disc 70 of a rotation speed detecting means is fixed at one end of the rotor 68. The slit disc 70 rotates between a light emitting element 72 and photoelectric transducer 73 which are fixed on a frame 71. At the periphery of the slit disc 70, fifty slits for passing light are provided with uniform pitch, so that the photoelectric transducer 73 generates 50 pulses per one rotation of the rotor 68. The frame 71 of the motor is fixed to the copying apparatus housing 11 and a gear 75, if any, is fixed to the shaft 65. Other motors 61, 62 and 63 have the same construction.

FIG. 4 shows a sectional view of the copying apparatus housing 11, with assembly units such as the photoreceptor drum 12, the developing device 15, the fixing device 41, the cleaner 19, the copy paper sheet feeder 40 and the optical scanning mechanism dismantled. That is, FIG. 4 shows the way how the motors 60, 61, 62 and 62 are fixed on the housing wall.

Inside the housing wall driving gears 75, 76, 77 and 78 are mounted on respective shafts of the motors 60, 61 62 and 63.

When the photoreceptor drum 12 is mounted in the housing 11, a driven gear (not shown) fixed to the shaft of the photoreceptor drum 12 engages with the driving gear 76 fixed to the motor 61 for driving the photoreceptor, so that the driving force of the motor 61 is transmitted to the driven gear. In the similar way, the driving force is transmitted to the rotary sleeve 32 of the developing device 15 through the driving gear 78 fixed to the motor 63 and a driven gear (not shown) which is engaged with the gear 78 and fixed to the shaft of the rotary sleeve 32. The driving powers of the motors 62 and 63 are transmitted, to the fixing device 41 and optical scanning mechanism, respectively in the like manner. The reduction gear ratios from the driving gears 75, 76 and 77, which drives the optical scanning mechanism, the photoreceptor drum 12 and the fixing roller 42, to the driven gears are selected wall 1/9. Therefore, when the motors 60, 61 and 62 rotate at a speed of 420 r.p.m., the driven shafts of the respective units rotate at a speed of 46.7 r.p.m. On the other hand, in this embodiment of the present invention a rotation speed of the motor 63 for driving the developing device 15 is selected 1000 r.p.m., and the rotary sleeve 32 is made rotate at a speed of 200 r.p.m. by reduction means of a reduction gear mechanism of 1/5 reduction ratio. A roller 35 for feeding-in copy paper sheet has a driven gear (not shown) which engages with a driving gear 76 of the motor 61 for driving the photoreceptor drum 12, so that the roller 35 rotates at the same peripheral speed as that of the photoreceptor drum 12.

A rotation speed controlling of the motors 60 to 63 is explained below. FIG. 7 shows a block diagram of the motor controlling circuit of the present invention. A reference signal generator 110 generating a frequency of 350 Hz is provided in the copying apparatus. When the motor 61, for example, for driving the photoreceptor drum 12 is energized, the photoelectric transducer 73 provided in the motor 60 and constituting the rotation speed detecting means 111 generates pulses. In this case, since the photoelectric transducer 73 generates 50 pulses per one rotation of the rotor 68 as mentioned above, when the rotor 68 rotates at the speed of 420 r.p.m. 350 pulses per minutes are generated. The rotation speed of the motor 61 is controlled by a phase detecting and control circuit 112, which compares the phases of the output signal of the rotation speed detecting means 111 with that of the reference signal generator 110. The phase detecting and control circuit 112 controls the motor speed in a manner to maintain the phase difference to a constant value by increasing the power supply voltage for the motor 61 when the speed is below a preset value and by reducing the power supply voltage when the speed is above the preset value. Rotation speed detecting means 117, 118 and 119 respectively comprises the photoelectric transducers in the like manner to that of 73 and the output signals thereof are fed to respective phase detecting and control circuits 113, 114 and 116, to which the output signal of the reference signal generator 110 is also fed as a reference signal. In the same manner as that of the motor 61, the rotation speed of the motors 60 and 62 are controlled by the phase detecting and control circuits 113 and 114, respectively, thereby synchronizing with the reference signal generator 110. The motor 63 for driving the developing device is to be driven at a higher speed than those of the motors 60, 61 and 62. Hence another reference signal generator 115 having a frequency of 833 Hz is provided for feeding a reference signal to the phase detecting and control circuit 116, and the phase detecting and control circuit 116 controls the motor 63 so as to keep a constant speed.

As described above, the output signals from the detection means 111, 117 and 118 for the rotational speeds of the three motors 60, 61 and 62 are respectively compared with the reference signals of the specified frequencies (350 Hz for the motors 61, 60 and 62 and 833 Hz for the motor 63) from respective reference signal generator 110 and 115, so as to compare their phases, and consequently the rotational speeds are controlled at the predetermined rate. Therefore, four motors 60, 61, 62 and 63 can be rotated at the precisely controlled rate even for a extremely short time period.

It is not always necessary to control the motor 63 for driving the developing device 15 by using the same output signal as of the other reference signal generator 115, but it is naturally possible to control the motor 63 by use of the same reference output signal from the generator 110 for the motors 60, 61 and 62.

The larger the number of the pulses per revolution of the motors 60, 61, 62 and 63 becomes, the more precisely the revolutional speed is controllable. Practically, satisfactory results are obtainable with an order of 50 pulses per revolution.

The copying operation of the copying apparatus in accordance with the first embodiment of the present invention is described in the following. When one wishes to make a copy of the original 24, the original 24 is placed at a specified place on the transparent platform 10, and then a start switch (not shown) is pressed. Consequently, the motor 61 for driving the photoreceptor 12, the motor 62 for driving the fixing device 41, and the motor 63 for driving the developing device 15 start rotating, and further the lamp 50 for illuminating the original 24 is lit. On the other hand, high voltages are respectively applied to the corona charger 13, the transferring corona charger 16, the copying paper separating charger 17, the photoreceptor discharger 18.

After a time lapse sufficient for rise up of light intensity of the illumination lamp 50 (0.4 second in this embodiment), the motor 60 for driving the optical scanning mechanism begins rotating and the first and second moving mirrors 25, 26 and 27 begin moving thereby scanning the original 24. At the same time, one sheet of copy papers is fed from the copy paper sheet feeder 40 linked by the gear to the motor 60. The electrostatic latent image corresponding to the image on the original 24 and formed on the photoreceptor 12 is developed thereby producing the toner image. The toner image is transferred by the corona charger 16 onto the copy paper, which is fed synchronously with the rotation of the photoreceptor 12. The charges on the copy paper are discharged by the copy paper sheet separating charger 17, and the copy paper is separated from the surface of the photoreceptor 12.

The copy paper removed from the photoreceptor 12 is then fed to the fixing device 41 and the transferred toner image is fixed on the copy paper by heating. And finally, the fixed copy paper is fed out from the copying apparatus housing 11. On the other hand, the residual charge on the photoreceptor 12 after the toner transferring is discharged by the discharger 18, and the still remaining residual toner image is wiped out by the cleaner 19.

The photoreceptor 12 keeps rotating at a predetermined constant speed during the scanning of the original 24 by the optical scanning mechanism. When the first moving mirror 25 reaches the scanning end position at right in FIG. 1, the motor 60 for driving the optical scanning mechanism begins rotating in the reverse direction at a higher speed. The reverse rotation is controlled by a switch 130 shown in FIG. 7, and during this reverse rotation time the phase detection and control circuit 113 does not operate, so that the reverse rotation of the motor 60 for returning the optical scanning mechanism to the starting position is not controlled by the reference signal, thereby enabling returning of the first moving mirror 25 as well as the second and third moving mirrors 26 and 27 to the starting position at a high speed. In the first embodiment of the present invention, the rotational speed of the motors 60, 61 and 62 is controlled that the rotational speed of the photoreceptor 12 is 200 mm/sec at the surface thereof, and that it takes 1.5 second for the first moving mirror 25 to move in the forward direction from the starting position to the end position, and it takes 0.4 second to return to the starting position by the reverse rotation of the motor.

One cycle of the copying operation completes, when the toner image on the photoreceptor 12 is transferred onto the copy paper and then this transferred copy paper is put out from the copying apparatus housing 11 passing through the fixing device 41. This means that the motors 61, 62 and 63 keep rotating for a while even after the scanning operation of the optical scanning mechanism and the subsequent reverse rotation of the motor 60 end their operation.

In case that one wishes to obtain more than one copied paper successively, the motors 61, 62 and 63 are operated to continuously rotate at the constant speed, and the motor 60 for driving the optical scanning mechanism is operated to rotate reciprocatively, by rotating for 1.5 second in the forward direction and for 0.4 second in the reverse direction.

As described so far, the operation of the optical scanning mechanism, the photoreceptor 12 and the fixing device 41 is very precisely controlled by the phase detection and control circuits 112, 113, 114 and 116 to attain the constant speed by utilizing the aforementioned pulses of very small time intervals. Therefore, the electrostatic latent image of the original 24 is precisely copied onto the copy paper without distortion such as expansion or contraction.

FIG. 6 is a side sectional view of a copying apparatus in accordance with a second embodiment of the present invention. Mechanical components of FIG. 6 with reference numbers same as those of FIG. 1 are similar to those shown in FIG. 1. Different from the first embodiment, a platform 100 for placing an original 24 linearly moves back and forth, thereby enabling to make the copying apparatus compact. An image transmitter 101 constituted by a transversely disposed linear array of optical fibers is employed here as the image projecting means for the purpose of making the copying apparatus in a compact form. Accordingly, moving mirrors for scanning the original are not used in the second embodiment, but an image of the original to be copied is projected through the image transmitter 101 onto the surface of a photoreceptor 12.

The image transmitter 101 may be called as an optical fiber lens, and is formed by a transverse linear array of optical fibers of about 1 mm or less in diameter and about 30 mm in length and the linear array is disposed transverse of the moving direction of the plaform. Each one of the optical fibers serves as a lens. The array of the optical fibers is lined up above the photoreceptor 12 to cover the full width thereof. The image of the original 24 to be copied is projected onto the surface of the photoreceptor 12 disposed under the lower tip of the image transmitter 101 with a specified gap inbetween.

The reciprocating movement of the platform 100 for placing the original is made in the similar manner to the driving of the moving mirrors 25, 26 and 27 of the first embodiment. That is, a gear 75 fixed to a shaft of an optical scanning means motor 60 is suitable for engagement with a known rack (not shown) disposed at a side tip of the platform 100 so as to obtain the reciprocating movement of the platform 100 by the reciprocating rotation of the motor.

In conclusion, the distinctive features of the copying apparatuses in accordance with the present invention are summarized below:

(i) The overall structure of the copying apparatus is simplified and accordingly the production thereof does not cost much. This owes to the employment of the unique structure where four flat type D.C. motors are fixed at the side wall of the copying apparatus housing so as to drive several mechanical units. By such construction, each individual units can be dismantled from the housing frame of the copying apparatus independently from other units.

(ii) The flat and coreless D.C. motors are small in size and have a high efficiency in comparison with the A.C. motor. Thus it is possible to mount them on the side wall of the copying apparatus housing within the limited spaces, thereby enabling the satisfactorily compact size of the overall copying apparatus. For example, the size of the copying apparatus in accordance with the first embodiment (fixed platform type) can be reduced by 20 to 40% in comparison with the conventional copying apparatus of the fixed platform type. On the other hand, the copying apparatus in accordance with the second embodiment (moving platform type) has a size (in volume) amounting to only 30% of the conventional copying apparatus of the same type.

(iii) Because of elimination of the chain linkage system, it is possible to remove the irregularity and distortion to result low resolving power of the copied image. Accordingly, it is possible to greatly improve the quality of the copied image.

What is claimed is:

1. An electrophotographic copying apparatus comprising:

a photoreceptor having a photoconductive outer layer which photoreceptor is rotatably disposed, a corona charger for preliminarily charging the photoconductive outer layer of said photoreceptor, an optical scanning means including illuminating means for an original to be copied, an optical system for projecting a light image from said original onto said preliminarily charged photoconductive layer and a driving means to drive at least the illuminating means and the optical system in a manner relatively to scan on the original, thereby to produce an electrostatic latent image on said photoconductive layer, a developing means for developing the latent image into a visible toner image by contact of toner on said conductive layer, a transferring means for transferring said toner image onto a transfer material sheet which is fed by a sheet feeding device, a cleaning means for removing residual toner after the transferring, a fixing means disposed in the path of the transfer material and including a fixing device for fixing the transferred visible toner image on said transfer material, a transfer material advancing means for advancing said transfer material from a feeder onto the outer surface of said photoreceptor and through said fixing means to an outlet, and an apparatus housing for, in operatively incorporated relation, containing the photoreceptor, the corona charger, the optical scanning means, the developing means, the transferring means, the cleaning means, the fixing means and the transfer material advancing means, wherein the improvement is that:

the apparatus housing comprises, on one side part thereof, a first motor for driving and coupled to the photoreceptor, a second motor for driving and coupled to the optical scanning means, each of said first motor and said second motor having a rotation speed detecting means, rotation speed of said first motor being predetermined constant, and rotation speed of said second motor during forward direction scanning for projecting image of said original onto the photoreceptor is selected to have a predetermined ratio to said predetermined constant speed by means of output signals of said rotation speed detecting means.

2. An electrophotographic copying apparatus in accordance with claim 1, which further comprises a third motor for driving and coupled to the developing means and a fourth motor for driving and coupled to the fixing means, each of the motors being disposed on said housing with their output shaft inwards the housing.

3. An electrophotographic copying apparatus in accordance with claim 1, wherein said ratio is 1:1.

4. An elecrophotographic copying apparatus in accordance with claim 1, including a third motor and wherein said fixing means comprises a heating and pressing roller driven by said third motor, the rotation speed of said third motor being controlled to be a predetermined ratio to said first motor by means of an output signal of a rotation speed detecting means contained therein.

5. An electrophotographic copying apparatus in accordance with claim 4, wherein rotation speeds of said first motor, said second motor and said third motor are equal with each other.

6. An electrophotographic copying apparatus in accordance with claim 4, wherein said developing means has a rotating non-magnetic sleeve which is driven by a fourth motor and contains at least one permanent magnet therein.

7. An electrophotographic copying apparatus in accordance with claim 6, wherein said first, second, third and fourth motors are flat type coreless D.C. motors.

8. An electrophotographic copying apparatus in accordance with any one of claims 1, 2, 3, 4, 5, 6 or 7, wherein said optical scanning means comprises a reciprocatively moving transparent platform for placing original to be copied thereon, and a linear array of a number of optical fibers disposed under the transparent platform for projecting light image of the original onto the photoreceptor.

* * * * *

UNITED STATES PATENT AND TRADEMARK OFFICE

CERTIFICATE OF CORRECTION

PATENT NO. : 4,330,196

DATED : May 18, 1982

INVENTOR(S) : Isao YAMAGUCHI

It is certified that error appears in the above-identified patent and that said Letters Patent is hereby corrected as shown below:

Column 7, lines 31-36, delete "In the embodiment of the present invention...of the copying apparatus housing 11."

Column 8, line 55, read "350 pulses per minutes" as --350 pulses per second--

Column 12, line 17, after "material" insert --sheet--

Column 12, line 18, after "material" insert --sheet--

Column 12, lines 45-46 read "developing" as --fixing--

Column 12, line 47, read "fixing" as --developing--

Signed and Sealed this

*Seventh* Day of *September 1982*

[SEAL]

*Attest:*

GERALD J. MOSSINGHOFF

*Attesting Officer*

*Commissioner of Patents and Trademarks*